US006659715B2

(12) United States Patent
Kuesters et al.

(10) Patent No.: US 6,659,715 B2
(45) Date of Patent: Dec. 9, 2003

(54) AXIAL COMPRESSOR AND METHOD OF CLEANING AN AXIAL COMPRESSOR

(75) Inventors: Bernhard Kuesters, Kamp-Lintfort (DE); Reinhard Moenig, Willich (DE)

(73) Assignee: Siemens Aktiengesellschaft, Munich (DE)

( * ) Notice: Subject to any disclaimer, the term of this patent is extended or adjusted under 35 U.S.C. 154(b) by 36 days.

(21) Appl. No.: 10/053,059

(22) Filed: Jan. 17, 2002

(65) Prior Publication Data

US 2003/0133789 A1 Jul. 17, 2003

(51) Int. Cl.[7] ..... F04D 29/00
(52) U.S. Cl. ..... 415/116; 415/117; 60/39.53
(58) Field of Search ..... 415/116, 117; 60/39.53, 39.3

(56) References Cited

U.S. PATENT DOCUMENTS

| | | | | |
|---|---|---|---|---|
| 4,808,235 | A | 2/1989 | Woodson et al. | 134/22.19 |
| 5,930,990 | A | 8/1999 | Zachary et al. | 60/39.53 |
| 6,398,518 | B1 * | 6/2002 | Ingistov | 417/244 |

FOREIGN PATENT DOCUMENTS

| | | |
|---|---|---|
| EP | 0 350 272 B1 | 5/1996 |

* cited by examiner

*Primary Examiner*—Edward K. Look
*Assistant Examiner*—Dwayne J. White
(74) *Attorney, Agent, or Firm*—Harness, Dickey & Pierce, P.L.C.

(57) ABSTRACT

An axial compressor includes a nozzle for injecting a cleaning fluid. The cleaning fluid is injected through the nozzles in a flow duct during operation, so that rear blading rows are also cleaned.

10 Claims, 2 Drawing Sheets

AXIAL COMPRESSOR AND METHOD OF CLEANING AN AXIAL COMPRESSOR

FIELD OF THE INVENTION

The invention generally relates to an axial compressor, in particular for a gas turbine. More preferably, it relates to a compressor including, a compressor inlet and a compressor outlet and including a flow duct which is arranged between the compressor inlet and the compressor outlet. The flow duct can be enclosed by a compressor casing and in which guide blades and rotor blades are arranged. It also generally relates to a method of cleaning such an axial compressor.

BACKGROUND OF THE INVENTION

A method of cleaning a gas turbine compressor is known from U.S. Pat. No. 4,808,235. As a rule, compressors of the axial type are employed for gas turbines. In such axial compressors, sequential rotor blade rings and guide blade rings are arranged in a flow duct. Air is highly compressed from the compressor inlet to the compressor outlet. This compressor air is then fed to a combustion chamber of the gas turbine where, together with fuel, it is burnt. The hot exhaust gases are guided through the turbine part, where they put a rotor into rotation by way of turbine blading. The rotational energy made available by the rotor also drives the compressor which is, as a rule, located on the same rotor.

The compressor of a gas turbine consumes a major part of the work performed by the turbine. The efficiency of the compressor is therefore of major importance to the overall efficiency of the gas turbine. It is the aerodynamic conditions in the flow duct of the compressor, in particular, which are responsible for the efficiency. These aerodynamic conditions are impaired by deposits on the compressor blading. Such deposits arise due to dirt particles in the induced air. The air is therefore usually filtered before entry into the compressor. With time, however, deposits are nevertheless caused by micro-particles which cannot be filtered out, and these deposits must then be washed off. For complete compressor cleaning, such washing demands greatly reduced operation of the compressor, which is not acceptable—particularly in the case of stationary gas turbines which are employed for the generation of energy. A cleaning fluid, for example distilled water, is added to the compressor inlet air for the washing process.

In order to maintain the compressor operation, it would be desirable to carry out "on-line" washing, i.e. washing of the compressor blading during compressor operation with, however, a certain reduction in power. Because of the strong increase in temperature of the compressor air caused by the compression, however, the added cleaning fluid evaporates so rapidly that rear rows of blading in the flow duct can no longer be washed. The method of U.S. Pat. No. 4,808,235 reduces this problem in the case of gas turbine aircraft engines by employing a cleaning fluid with a relatively high boiling point. The intention is also to achieve a low freezing point in order to avoid icing during flight operation.

A method and an appliance for cleaning air before entry into the compressor is known from EP 0 350 272B1. After an air filtration process and before entry into the compressor, the airflow is made uniform by way of a blading arrangement. It is subsequently nebulized with water and is then sprinkled with a coalescing medium. Finally, the air is dried.

U.S. Pat. No. 5,930,990 describes a method and an appliance for increasing the power of a gas turbine. Water is injected, before the compressor inlet, into the air induced by the compressor. The water evaporates in the compressor and, by this, cools the compressor air. The compressor power is reduced by this intermediate cooling, by means of latent heat, and the gas turbine power is therefore increased.

SUMMARY OF THE INVENTION

The invention is based on the object of providing an axial compressor. More preferably, it is directed to providing one in which "on-line" washing is also possible for compressor blading rows located further back in the flow duct. In addition, in one embodiment, the intention is to provide a particularly suitable cleaning method for an axial compressor.

An object is achieved by providing an axial compressor. A nozzle for injecting a cleaning fluid can be arranged in the flow duct in such a way that cleaning of at least some of the guide blades and rotor blades takes place by the injection of the cleaning fluid.

It is possible to introduce cleaning fluid into the flow duct downstream of the compressor inlet also during the compressor operation by using the nozzle located in the flow duct of the axial compressor, or also by using a plurality of such nozzles. By this, rear blading rows also can be efficiently cleaned in an "on-line" washing operation.

The nozzle can be arranged between two adjacent guide blades and/or between a guide blade and a rotor blade. Guide blades are adjacent to one another in the peripheral direction in a guide blade ring. Injection between two such guide blades can be realized with comparatively simple apparatus.

The nozzle can also be located in a guide blade. As an example, the guide blade can have a hollow configuration so that the cleaning fluid is guided within the guide blade. In particular, this provides the advantage that the cleaning fluid can be injected into the flow duct at a defined radial height or distributed over the complete radial height.

The nozzle can, in addition, be located in the compressor casing or can, however, be placed at a distance from the compressor casing by using a lance leading through the compressor casing. In a preferred embodiment, the lance can then be radially traversed. This provides, on the one hand, the advantage of a variable radial height for the injection of the cleaning fluid. The nozzle can, for example, be traversed over the complete height of the flow duct during the injection, by which subsequent blading can be efficiently cleaned over its complete height. In addition, this provides the advantage that the nozzle can be completely retracted from the flow duct after a cleaning operation. This avoids aerodynamic impairment due to the nozzle.

If the nozzle is arranged on the compressor casing, this provides a possibility, which is favorable from the point of view of the apparatus required, of supplying the cleaning fluid to the nozzle from outside and through the compressor casing. It is expedient to locate the nozzle radially above a rotor blade. By this, a complete rotor blade ring, which rotates past the nozzle during operation, can be cleaned in a targeted manner.

The axial compressor is preferably designed for a gas turbine, in particular for a stationary gas turbine. Particularly in the case of stationary gas turbines of large power, such as are employed for the generation of electrical energy in power stations, an outage period because of compressor cleaning is extremely undesirable. On the other hand, high efficiencies are very important, precisely for such gas turbines, so that a deterioration of efficiency due to dirt on the compressor blading is also unacceptable. Efficient "on-line" washing of the compressor is therefore of particularly great importance in this case. In the case of the stationary gas turbines of high power, it is known that dirt depositions cause sacrifices in efficiency, precisely in the case of the rear blading rows, because particularly high flow Reynolds numbers are present in this region.

An object is further achieved by providing a method of cleaning an axial compressor. A cleaning fluid can be injected into the flow duct at an injection position behind the compressor inlet, in the flow direction, after a first row of guide blades and before the compressor outlet during the compressor operation, in such a way that at least some of the guide blades and rotor blades are cleaned by the cleaning fluid.

BRIEF DESCRIPTION OF THE DRAWINGS

An embodiment example of the invention is explained in more detail below, including the drawings, wherein.

Mutually corresponding parts are provided with the same designations in both figures.

DETAILED DESCRIPTION OF THE PREFERRED EMBODIMENTS

Figure 1:
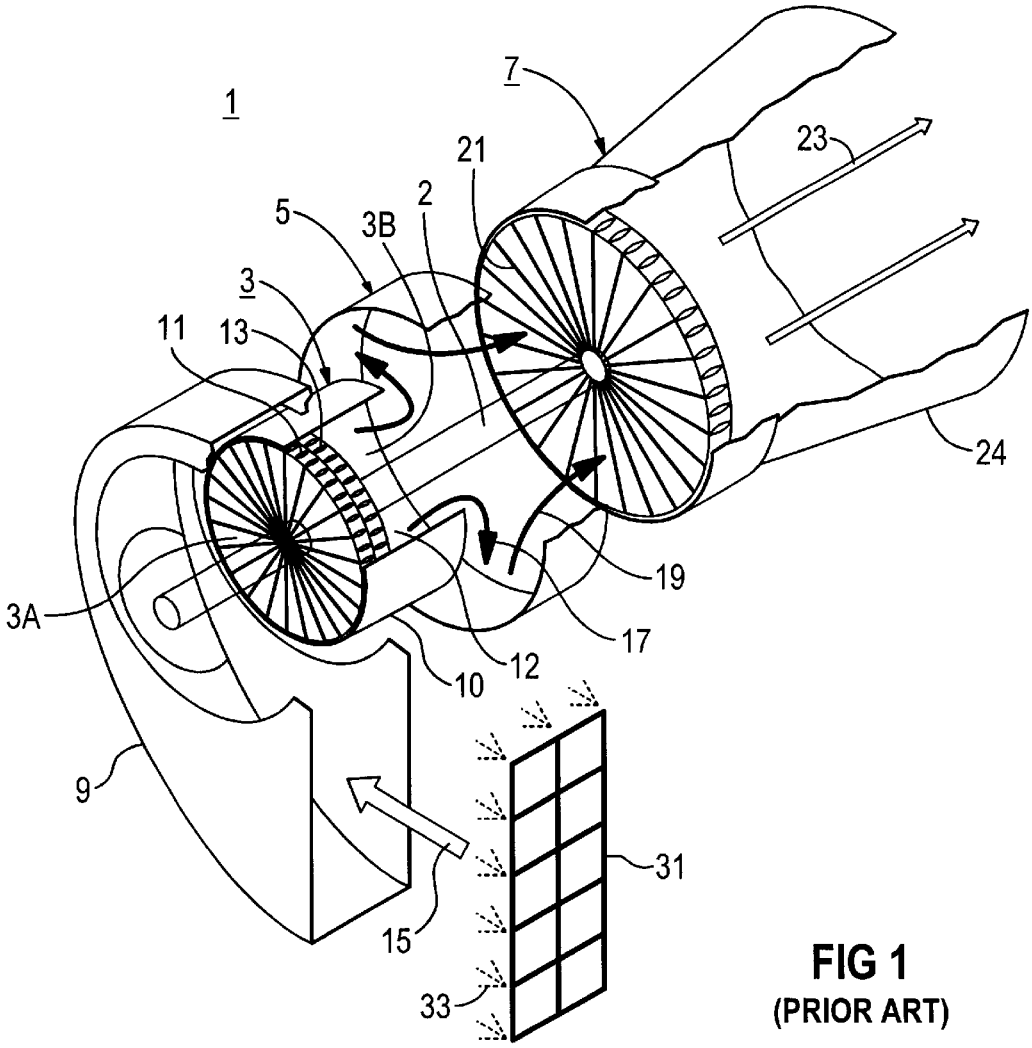
FIG 1 (PRIOR ART)
FIG. 1 shows, diagrammatically and in perspective view, a gas turbine having a compressor.

FIG. 1 shows a known gas turbine 1 having an axial compressor 3, a combustion chamber 5 and a turbine part 7 arranged on a common rotor 2. The axial compressor 3 has a compressor inlet 3A and a compressor outlet 3B. An induction casing 9 is located before the compressor inlet 3A. The axial compressor 3 has a compressor casing 10, which surrounds a flow duct 12. Rotor blades 11 and guide blades 13 are arranged in alternate sequential blading rings in the flow duct 12, only one rotor blade ring and one guide blade ring being visible.

During operation of the gas turbine 1, air 15 is induced from the surroundings into the induction casing 9. The air 15 is highly compressed in the axial compressor 3 to form compressor air 17. This compressor air 17 is fed to the combustion chamber 5 where this compressor air 17, together with fuel, is burnt and expands to form a combustion gas 19. The combustion gas 19 is fed to the turbine part 7. Turbine blading 21 is located in the turbine part 7 in sequential blading rings. The combustion gas 19 puts the rotor 2 into rotation and emerges as an exhaust gas 23 from the gas turbine 1 via the diffuser 24. The rotational work of the rotor 2 can, for example, drive an electrical generator for the generation of electrical energy. A substantial part of the rotational energy is employed for the axial compressor 3. The efficiency of the axial compressor 3 therefore influences the efficiency of the overall gas turbine 1 to a substantial extent. The aerodynamic conditions in the flow duct 12, in particular, influence the efficiency of the axial compressor 3. Dirt particles in the induced air 15 can lead to deposits on the compressor blading 11, 13 of the axial compressor 3.

The air 15 is therefore filtered through a cleaning and filtering system 31. Smallest particles, however, remain in the air 15 and can lead to deposits. A cleaning fluid 33 can be * supplied to the air 15 in "off-line" operation at greatly reduced power. The compressor blading 11, 13 is washed by this means.

Figure 2:
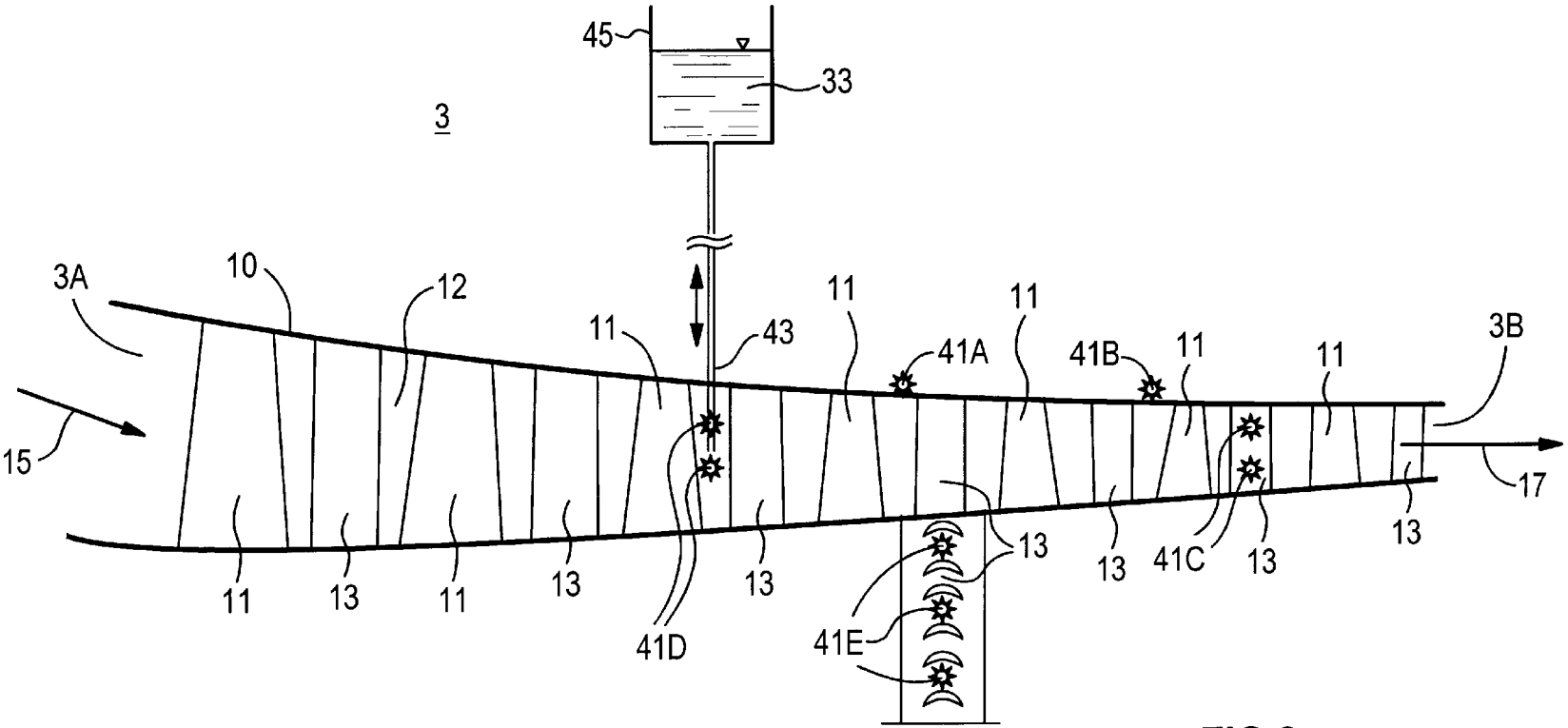
FIG. 2 shows an axial compressor according to the invention.

In order to convey cleaning fluid 33 to the rear compressor blading 11, 13 in "on-line" operation also of the axial compressor 3, i.e. under worthwhile load, nozzles 41 are located in the flow duct 12 at certain positions in the axial compressor 3, as shown in FIG. 2. A nozzle 41A is located on the compressor casing 10 between a rotor blade 11 and a guide blade 13. A nozzle 41B is located on the compressor casing 10 between a guide blade 13 and a rotor blade 11. Nozzles 41C are located in a guide blade 13, in particular as openings from an internal cavity, over the complete height of guide blade 13.

A further nozzle 41D is located on a lance 43 which can be radially traversed. The lance 43 can be traversed over the height of the flow duct 12 and, by this, clean subsequent blading 11, 13 over its complete height. Cleaning fluid 33 for the nozzle 41D, as also for the other nozzles 41, is supplied from a reservoir 45 via the lance 43. A further position for nozzles 41 is indicated by the nozzles 41E, which are located between adjacent guide blades 13 of a guide blade ring.

Compressor blading 11, 13 located comparatively far to the rear in the flow duct 12 can also be efficiently cleaned in "on-line" operation by the supply of cleaning fluid 33 via the nozzles 41.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An axial compressor, comprising a compressor inlet and a compressor outlet;

a flow duct, arranged between the compressor inlet and the compressor outlet, enclosed by a compressor casing and in which guide blades and rotor blades are arranged; and at least one nozzle for injecting a cleaning fluid, arranged in the flow duct such that cleaning of at least some of the guide blades and rotor blades occurs upon the injection of the cleaning fluid, wherein the nozzle is located in a guide blade.

2. The axial compressor as claimed in claim 1, wherein the nozzle is located between a guide blade and a rotor blade.

3. A gas turbine comprising the axial compressor as claimed in claim 1.

4. The axial compressor as claimed in claim 1, wherein the nozzle is placed at a distance from the compressor casing by a lance leading through the compressor casing.

5. The axial compressor as claimed in claim 4, wherein the lance is radially traversable.

6. An axial compressor, comprising a compressor inlet and a compressor outlet;

a flow duct, arranged between the compressor inlet and the compressor outlet, enclosed by a compressor casing and in which guide blades and rotor blades are arranged; and at least one nozzle for injecting a cleaning fluid, arranged in the flow duct such that cleaning of at least some of the guide blades and rotor blades occurs upon the injection of the cleaning fluid, wherein the nozzle is located between a guide blade and a rotor blade, and wherein the nozzle is placed at a distance from the compressor casing by a lance leading through the compressor casing.

7. A gas turbine comprising the axial compressor as claimed in claim 6.

8. A gas turbine including an axial compressor, the axial compressor comprising:

a compressor inlet and a compressor outlet;

a flow duct, arranged between the compressor inlet and the compressor outlet, enclosed by a compressor casing and in which guide blades and rotor blades are arranged; and at least one nozzle for injecting a cleaning fluid, arranged in the flow duct such that cleaning of at least some of the guide blades and rotor blades occurs upon the injection of the cleaning fluid, wherein the nozzle is located between a guide blade and a rotor blade.

9. A method of cleaning an axial compressor, including a compressor inlet and a compressor outlet and a flow duct arranged between the compressor inlet and the compressor outlet, the flow duct being enclosed by a compressor casing and including guide blades and rotor blades arranged therein, the method comprising:

injecting a cleaning fluid into the flow duct at an injection position behind the compressor inlet, in the flow direction, after a first row of guide blades and before the compressor outlet during the compressor operation; and cleaning at least some of the guide blades and rotor blades by the injected cleaning fluid, wherein a nozzle is used for injecting the cleaning fluid, and, wherein the nozzle is located in a guide blade.

10. The method of claim 9, wherein the method is for cleaning an axial compressor in a gas turbine.

* * * * *